United States Patent [19]

Staat

[11] Patent Number: 4,738,128

[45] Date of Patent: Apr. 19, 1988

[54] SKEW-ROLLING STAND

[75] Inventor: Karlhans Staat, Ratingen, Fed. Rep. of Germany

[73] Assignee: Kocks Technik GmbH & Co., Hilden, Fed. Rep. of Germany

[21] Appl. No.: 900,825

[22] Filed: Aug. 27, 1986

[30] Foreign Application Priority Data

Sep. 17, 1985 [DE] Fed. Rep. of Germany ..... 3533119

[51] Int. Cl.[4] ..... B21B 19/06

[52] U.S. Cl. ..... 72/96; 72/100

[58] Field of Search ..... 72/95, 96, 97, 99, 100, 72/250, 426

[56] References Cited

U.S. PATENT DOCUMENTS 1,141,426 6/1915 Simpkins ..... 72/97
1,882,655 10/1932 Clark ..... 72/100
2,034,132 3/1936 Diescher ..... 72/100
3,348,399 10/1967 Prieur ..... 72/97

FOREIGN PATENT DOCUMENTS 1427915 1/1973 Fed. Rep. of Germany ..... 72/96

*Primary Examiner*—Lowell A. Larson
*Attorney, Agent, or Firm*—Buell, Ziesenheim, Beck & Alstadt

[57] ABSTRACT

In a skew-rolling stand for rolling hollow billets, in particular for stretching hollow billets into tubular blooms, work material guides are provided at the entry end and/or at the delivery end. These work material guides comprise a preferably motor-driven guide tube (19) which can be rotated about its longitudinal axis, which considerably improves guiding and offers additional protection against heat losses and scaling of the work material. The guide tube does away with the need for a re-heating furnace and allows immediate subsequent finish-rolling.

10 Claims, 4 Drawing Sheets

SKEW-ROLLING STAND

The invention relates to a skew-rolling stand for rolling hollow billets, and is particularly applicable to a skew-rolling stand for stretching hollow billets into tubular blooms.

In the manufacture of seamless tubes, it is known to pierce a solid billet in the longitudinal direction using a skew-rolling stand, wherein the hollow billet being formed in this way is rolled onto a rod disposed at the delivery end and provided on its end face with a plug. During pierce-rolling, the rotating rod is guided in the radial direction and thus protected against buckling. These guides are opened when the hollow billet being pushed onto the rod reaches them. Following rolling and removal of the rod, the resulting hollow billet is ejected at the side and passes by way of a transverse conveyor to the insertion table of a second skew-rolling stand which is used to stretch the hollow billet and is in the form of, for example, a Diescher or Assel rolling stand. In this type of skew-rolling stand, the hollow billet rotates at a relatively high peripheral speed of, for example, 5 to 6 meters per second, whereas the axial feed movement is significantly slower and is approximately 1 meter per second. As a result, it is necessary to guide the hollow billet reliably upstream and downstream of the skew-rolling stand, preferably at the delivery end where, having been stretched into a tubular bloom, it is considerably longer and has a considerably thinner wall. In the known skew-rolling stands, such guides comprise channels open at the top or roll guides adjusted to the respective tubular bloom diameter. The roll guides are opened to eject the tubular bloom.

The known channel guides have the disadvantage that their guide faces are stationary and hence there is considerable friction between them and the surface of the rotating work material. This friction causes the work material to jump and knock inside the channel guide, in particular when the mandrel rod is retained, and is thus no longer leading at the delivery end, so that not only the channel itself becomes worn, but also considerable damage is caused to the surface of the work material. In order to limit this damage to a tolerable level, the peripheral speed of the work material, and hence the run-through speed and output of the skew-rolling stand cannot be increased. Furthermore, the length of the bloom is limited.

With roll guides, the above-mentioned friction is reduced, but still occurs because the guide rolls are driven by the work material via its outer surface. The guide rolls, which are stationary between the individual rolling processes, thus have to be accelerated via the work material, which leads to damage to the work material surface. It has thus already been considered to drive these guide rolls in order to avoid said surface damage and to permit a greater work material length. The expenditure required to do this is, however, extraordinarily high, and has thus not been implemented for reasons of economy. Furthermore, damage to the work material surface is also caused, in the case of the known roll guides, because the guide rolls can only be disposed at particular intervals, that is, the work material can only be supported for a relatively short axial length. The curvature of the rolls is opposed by the curvature of the work material surface, so that the length and width of the guiding surface are very small. This, together with the fact that the work material performs a screw-like movement to which even guide rolls inclined with respect to one another cannot be completely adapted, results in damage to the work material surface. Furthermore, with regard to their mountings, the guide rolls must be kept cool as a result of which they withdraw a considerable quantity of heat from the work material. A considerable quantity of heat is also lost from the work material in the channel guides open at the top. As a result, it is generally not possible to carry out further processing of the work material directly beyond the known skew-rolling stands, but rather it is necessary to re-heat it before finish-rolling. To do this, a suitable re-heating furnace is required, with the resulting energy consumption and space requirement.

It is an object of the invention to improve the work material guides in skew-rolling stands of the type mentioned at the beginning in order to increase the performance of the skew-rolling stands and to improve the quality of the work material.

This object is achieved in accordance with the invention in that at least the work material guide at the delivery end is in the form of a preferably motor-driven guide tube which is rotatable about its longitudinal centre axis, is externally guided radially and axially and surrounds the run-through axis of the work material coaxially and has an inner diameter which is somewhat larger than the outer diameter of the work material.

As a result, the work material upstream of the rolls, and in particular beyond the rolls, is in a guide which rotates at approximately the same rotational speed and in the same direction of rotation as the work material and does not have to be driven by said work material. With a motor-driven guide tube, it is possible to adapt its rotational speed to the rotational speed of the work material and thus to limit the relative speed and hence the friction between the work material surface and the guide tube to a minimum. Friction is then essentially limited only to the longitudinal movement of the work material within the guide tube, so that surface damage is largely avoided. As a result of the greatly reduced friction, the work material is no longer made to jump or knock, but is satisfactorily guided within a guide tube closed on all sides. It is not possible for it to jump out, as is the case in the known channel guides. Furthermore, the work material is guided for almost the entire axial length, and as a result of the parallel curvatures of the work material surface and the guiding inner surface of the guide tube, the contact surface is also considerably larger than in the known guides. The improvement in the guiding of the work material thus obtained enables rolling to be carried out at higher rotational speeds, as a result of which a clear increase in the run-through speed, and hence in the roller performance, is achieved. The larger internal diameter of the guide tube compared with the outer diameter of the work material allows, on the one hand, a relatively accurate guiding of the work material and, on the other hand, ensures that the work material does not stick in the guide tube. When rolling work material of different diameters, it may be necessary to change the guide tube in order to prevent the space between its inner surface and the surface of the work material from becoming too small or too large. However, it is in no way necessary to use a different guide tube for each small change in diameter.

Furthermore, the guide tube can be moved very close to the rolls of the skew-rolling stand at the entry and delivery ends. Thus the work material is satisfactorily guided at the entry end until the last moment and, at the delivery end, guiding commences again at the first short longitudinal section of the outgoing work material. With the guide tube of the skew-rolling stand according to the invention, it is also possible to roll hollow billets having particularly thin walls, as these billets are protected at the entry end by the guide tube against premature cooling. At the delivery end, the guide tube of the skew-rolling stand according to the invention is particularly advantageous for thin-walled hollow billets as they are guided in a particularly protective manner. As a result, the skew-rolling stand according to the invention can be used to roll hollow billets or tubular blooms which have thinner walls and greater lengths than those rolled by the known types.

A particular advantage of the guide tube in the skew-rolling stand according to the invention is to be found in the fact that the work material is surrounded on all sides in the radial direction, and in this way local temperature differences and otherwise occurring heat losses due to radiation can be largely avoided. It is therefore possible to feed the work material to finish-rolling stands without re-heating it, so that the costs of purchasing and operating a re-heating device, as well as the space it requires, are saved. To this end, it has proven to be advantageous to enclose the guide tube on the outside with a heating, insulating or cooling jacket. It is thus possible to correct the temperature of the work material as necessary, even when it is too high for further processing. Preheating before commencement of rolling is also possible. It is recommended that, in the case of guide tubes of different internal diameters, the outer diameter of their heating, insulating or cooling jacket should be the same, at least in the region of its mounting. If the heating, insulating or cooling jacket always has the same diameter in the region of the rolls carrying and driving the guide tube, such rolls do not have to be adjusted to keep the longitudinal centre axis of the guide tube coaxial with the run-through axis of the work material.

Furthermore, it is advisable to provide the inside of the guide tube with an inert gas or a deoxidizing lubricant. This considerably reduces the formation of scale and is extremely advantageous for the surface quality of the work material.

In a preferred embodiment of the invention, the guide tube is divided into two or more longitudinal sections and, in the region of at least one of the portions between said longitudinal sections, motor-driven drive rolls are provided which are radially adjustable relative to the work material and drive said work material optionally in the axial direction. In this way it is possible to roll work material of varying length, without causing any difficulties in removal from the guide tube. If a piece of work material is shorter than the guide tube, it is engaged by the drive rolls in the region of the portions between the longitudinal sections following rolling and is conveyed in the axial direction when the drive rolls move in the radial direction to the work material and engage with it. The work material is then pushed out of the guide tube until the leading end can be engaged by a roller table, another driver or a rolling line connected downstream. During the rolling process, the drive rolls are separated in the radial direction and do not touch the work material. Such a portion between the longitudinal sections of the guide tube can be closed off, for example by a sliding sleeve, in order to avoid localised heat losses. Furthermore, such portions have the advantage that scale can be removed from or fall out of the inside of the guide tube and that, if necessary, any work material remaining in these sections can be divided and, if required, removed. Furthermore, sub-division of the guide tube allows it to be manufactured in sections. However, it is particularly advantageous that, in a sub-divided guide tube, a new hollow billet can be rolled while the trailing longitudinal section of the hollow block which has just been rolled out into a tubular bloom is still in the end section of the guide tube at the delivery end and is protected against cooling off too sharply. This end section of the guide tube must then be stationary because the leading longitudinal section of this first tubular bloom is, for example, in a sizing mill or a stretch-reducing mill and is not rotating.

The section of the guide tube disposed directly beyond the rolls of the skew-rolling stand must however rotate in order to allow the following hollow billet at the delivery end to be guided correctly. Sub-dividing the guide tube into several longitudinal sections allows both to happen at the same time, which reduces the idling times of the skew-rolling stand and significantly improves the output of the entire system. Furthermore, in a guide tube sub-divided into separate longitudinal sections, it is possible to accelerate, rotate, brake or stop the individual longitudinal sections in dependence on the entry and delivery of the work material at different times. It is thus possible to start up and brake gently.

However, it is also possible to make the guide tube or a longitudinal section thereof displaceable in the axial direction. This is particularly to be recommended when hollow billets or tubular blooms are being produced of substantially the same length, whose leading ends project out of the guide tube. These can then be engaged by a driver or rolling stand connected downstream and withdrawn from the guide tube. Thus, if the guide tube is displaceable in the axial direction, the work material can be inserted with the guide tube into the driver, or similar, connected downstream. It is thus possible to dispense with one or even several additional rollers in the region of the guide tube.

It can also be practical if the guide tube together with the work material therein can be ejected to the side from the run-through axis of the work material and, following axial withdrawal, can be returned to the region of the run-through axis of the work material by way of a return arrangement. This embodiment of the invention is to be recommended above all for systems having a particularly high capacity because the next hollow billet can be immediately rolled directly following the rolling and delivery of a work material piece from the skew-rolling stand by means of rapid ejection of the guide tube with the work material piece and immediate insertion of a new empty guide tube.

In a particularly advantageous embodiment of the invention, the run-through axis of the work material of the skew-rolling stand and its guide tubes form a straight line with the work material run-through axis of a reducing or sizing rolling line connected directly downstream thereof. Such an arrangement of a skew-rolling stand and a finish-rolling line in a straight line has the great advantage that the transport paths of the work material are thus kept extremely short, so that heat losses remain low and intermediate re-heating is not necessary. Furthermore, tubular blooms of any length within broad limits can be rolled. In addition, the entire system requires only a small amount of room. Such an arrangement is, however, only possible with the guide tube in a skew-rolling stand according to the invention. This guide tube advantageously prevents premature cooling-off of the work material, which already has a very thin wall at this point and which is leaving the skew-rolling stand in the axial direction relatively slowly and hence requires a relatively long time before entering the rolling lines connected downstream. If the guide tube were not available, the work material would have to be re-heated, for which purpose a re-heating furnace would have to be added which would not be possible with this type of arrangement.

The invention can be particularly well applied to a skew-rolling stand in which the mandrel rod is disposed at the entry end, where it is retained during the rolling process. The gap between the skew-rolling stand and the finish-rolling lines connected downstream thereof can then be kept particularly small, the work material incurring minimum heat loss. The guide tube is then no longer stressed by the heavy, solid mandrel rod lying inside the work material, and complex removal of the mandrel rod downstream of the skew-rolling mill from the tubular bloom and return of the mandrel rod to the rolling line is no longer necessary.

The invention is further described, by way of example, with reference to the accompanying drawings, in which.

Figure 1:
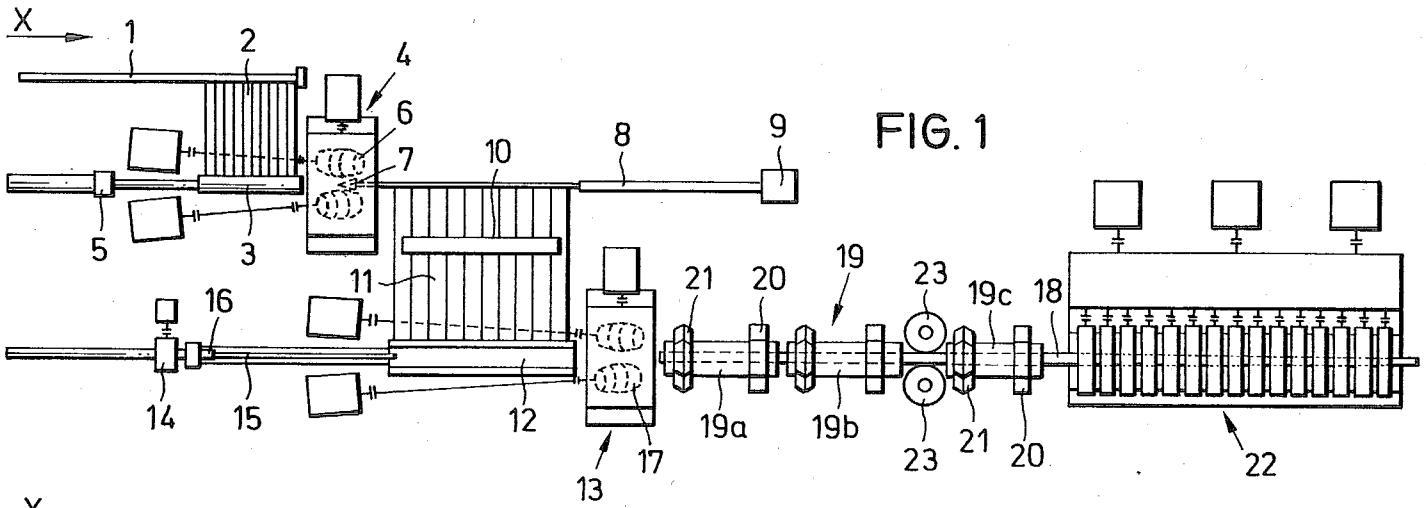
FIG. 1 is a plan view of a system having a skew-rolling mill according to the invention and a sub-divided guide tube at the delivery end.

FIG. 1 shows a roller table 1 by way of which solid billets can be supplied from the direction of the arrow X from a furnace (not shown) in which they have been heated up to rolling temperatures. These billets are fed by way of a transverse conveyor 2 to an insertion channel 3 of a skew-rolling stand 4. By means of a pusher 5, a billet lying in the insertion channel 3 is pushed between the rolls 6 of the skew-rolling stand 4. Once the billet has been engaged by the rolls, it is rolled out from left to right as in FIG. 1, and in doing so is pushed over a plug 7 onto a rod 8 which is prevented from buckling in a known way in the radial direction by guides (not shown) and against axial displacement by a support 9 so that the rod 8 with the plug 7 thereon can only perform a rotational movement about its longitudinal axis. In FIG. 1, the rod 8 and the support 9 are shown in the withdrawn position following removal of the plug 7 and the extraction of the rod 8 from a hollow billet 10 produced in this way.

The hollow billet 10 is on a transfer table 11 from where it rolls into an insertion channel 12 of a second skew-rolling stand 13. The skew-rolling stand 13 has a pusher 14 which initially pushes a mandrel rod 15 into the longitudinal bore of the hollow billet 10. This is carried out with the aid of a shaft rod 16 whose diameter is greater, such that the front end section of the mandrel rod 15 facing the skew-rolling stand 13 projects from the hollow billet 10. As the outer diameter of the shaft rod 16 is larger than the inner diameter of the longitudinal bore of the hollow billet 10, the shaft rod 16, the mandrel rod 15 and the hollow billet 10 can be advanced between the rolls 17 of the skew-rolling stand 13. The pusher 14 can retain the mandrel rod 15 by way of the shaft rod 16 so that the free end section of the mandrel rod 15 remains between the rolls 17 of the skew-rolling stand 13, whereas the hollow billet 10 is stretched by the rolls 17 and, its diameter reduced, is rolled off the mandrel rod 15.

The tubular bloom 18 produced in this way passes downstream of the skew-rolling stand 13 into a guide tube 19, whose internal diameter is somewhat larger than the outer diameter of the tubular bloom 18, so that the latter can be satisfactorily guided in the guide tube 19. The guide tube 19 itself is guided by guide rolls 20 and 21 which surround the guide tube 19 in threes at several points and guide in the radial direction. The V-shape of the guide rolls 21 and the corresponding prismatic shape of the running surface of the guide tube 19 for the guide rolls 21 permit the guide tube 19 to be retained in the axial direction too. The guide rolls 20 and/or 21 are driven by one or more motors (not shown) in such a way that the guide tube 19 rotates about its longitudinal axis at the same speed as the tubular bloom 18 for as long as the latter is engaged by the rolls 17 of the skew-rolling stand 13, which is no longer the case in FIG. 1. In FIG. 1, the tubular bloom 18 has already entered a sizing or stretch-reducing rolling line 22 connected downstream, and without the mandrel rod 15, which has been withdrawn together with the shaft rod 16 in expectation of the following hollow billet 10 in the insertion channel 12. Once the tubular bloom 18 has entered the stretch-reducing rolling line 22, it no longer rotates about its longitudinal axis so that the guide tube 19 should no longer rotate either, but should be held by the guide rolls 20 and 21 at a standstill in the radial and axial direction. As a tubular bloom 18 cannot have its leading end section in the stretch-reducing rolling line 22 and its trailing end section in the skew-rolling stand 13 at the same time, as the former requires a stationary or axially moving tubular bloom 18 and the latter a rotating tubular bloom 18, the gap between the skew-rolling stand 13 and the stretch reducing rolling line 22 must be larger than the longest tubular bloom 18 expected. Once the trailing end of the tubular bloom 18 has just left the skew-rolling stand 13, the leading end section of the tubular bloom 18 is still upstream of the first stand of the stretch-reducing rolling line 22. As a result, there is no feed at all at this moment. In order to allow the tubular bloom 18 to enter the stretch-reducing rolling line 22, the guide tube 19 is divided into a total of three longitudinal sections 19*a*, 19*b* and 19*c* which are each guided and held in the above-described manner in the radial and axial directions. At the point between the longitudinal sections 19*b* and 19*c* of the guide tube 19, two drive rolls 23 are disposed which can be moved radially towards or away from the tubular bloom 18 and which are driven by a motor (not shown). At the above-described moment, that is immediately after the trailing end of the tubular bloom 18 has left the skew-rolling stand 13, the drive rolls 23 are moved towards each other and hence against the tubular bloom 18, so that the latter is driven by the rotating drive rolls 23 in the axial direction and is pushed into the stretch-reducing rolling line 22. Once the latter has engaged the tubular bloom 18, the drive rolls 23 are separated again so that they no longer touch the tubular bloom 18. The individual longitudinal sections 19*a*, 19*b* and 19*c* of the guide tube 19 can, if necessary and for the purposes of repair, be individually removed and, if required, tilted, which is possible, for example, following removal of the upper one of the guide rolls 20 or 21.

Figure 2:
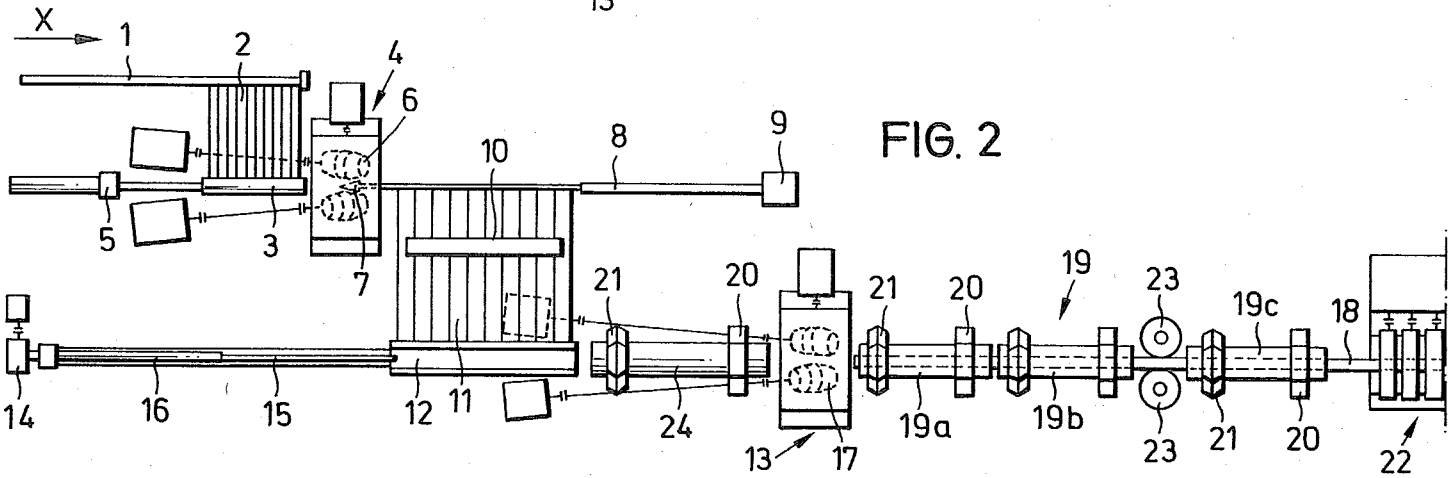
FIG. 2 is a plan view of a system having a skew-rolling stand according to the invention and a guide tube at both the entry and delivery ends.

FIG. 2 shows a system which is substantially the same as the system in FIG. 1. It differs from the system in FIG. 1 only in that a guide tube 24 is also disposed at the entry end upstream of the skew-rolling stand 13 for stretching the hollow billets 10, the design and position of which guide tube 24 are substantially the same as those of the guide tube 19 at the delivery end. It too is held and driven by guide rolls 20 and 21, but has a clearly shorter length, because the hollow billet 10 at the entry end of the skew-rolling stand 13 is considerably shorter and a longer length of the guide tube 24 is not necessary.

Figure 3:
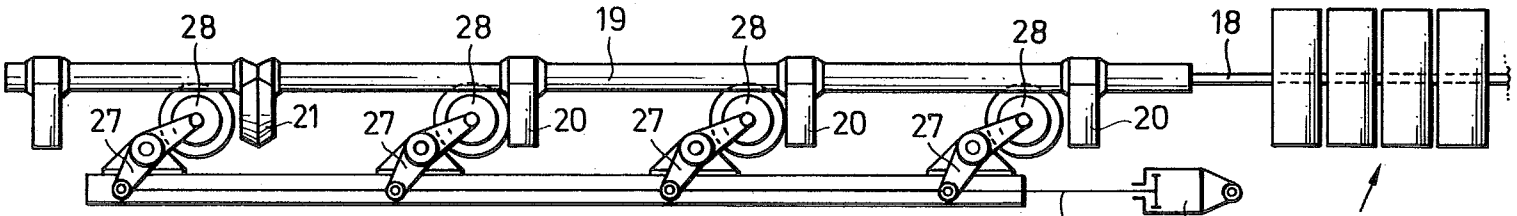
FIG. 3 is a side view of an undivided guide tube at the delivery end.

FIG. 3 shows another mounting of the guide tube 19 at the delivery end. It is formed in one piece such that it is sufficient to provide V-shaped guide rolls 21 at one point only in order to prevent axial displacement of the guide tube 19. For this reason, only cylindrical guide rolls 20 have otherwise been used. Furthermore, in this embodiment there is no upper guide roll 20 or 21. The guide tube 19 merely rests on a plurality of guide rolls 20 and 21 disposed in pairs next to one another underneath the guide tube 19. In order to let the leading end of the tubular bloom 18 projecting out of the guide tube 19 enter the stretch-reducing rolling line 22 following termination of the stretching process, a working cylinder 25 is used to actuate a lifting rod 26 which lifts, by way of pivoted levers 27, lifting rolls 28 and the guide tube 19 which is thereby raised from the guide rolls 20 and 21. The motor-driven lifting rolls 28 allow the guide tube 19 and the tubular bloom 18 therein to be displaced towards the stretch-reducing rolling line 22, so that the projecting leading end section of the tubular bloom 18 is pushed into the stretch-reducing line 22 and engaged by it. As soon as this happens, the direction of rotation of the lifting rolls 28 is altered, so that the guide tube goes back to the left in FIG. 3, whereby the tubular bloom 18 is pulled further out of the guide tube 19 through the stretch-reducing rolling line 22. As soon as the guide tube 19 has reached its starting position, the work cylinder 25 is actuated in the opposite direction, which results in the lifting rolls 28 being lowered and the guide tube 19 returning to the position shown in FIG. 3.

Figure 4:
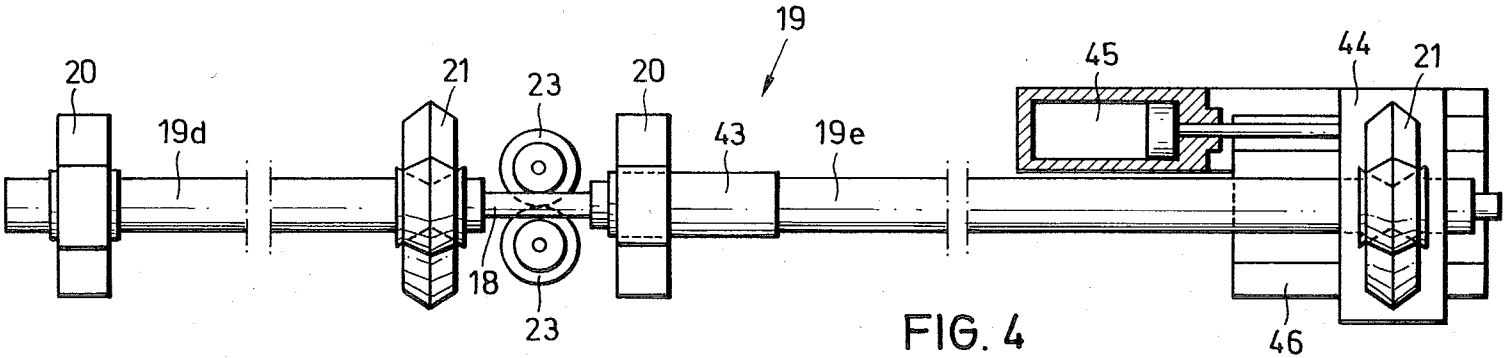
FIG. 4 is a plan view of a sub-divided guide tube at the delivery end.

FIG. 4 shows a guide tube 19 comprising two longitudinal sections 19*d* and 19*e*. Whereas the longitudinal section 19*d* substantially corresponds to longitudinal section 19*a* in FIGS. 1 and 2, longitudinal section 19*e* is of a somewhat different form. The running surface 43 of the cylindrical guide rolls 20 of the longitudinal section 19*e* is thus extended. The prismatic or V-shaped guide rolls 21 are mounted on a sliding carriage 44 which can be displaced in the axial direction on a guide 46 by the double-acting piston of the cylinder 45. As a result of this axial displacement, the longitudinal section 19*e* is far enough away from longitudinal section 19*d* for the drive rolls 23 to engage the bloom 18. The drive rolls 23 then transport the bloom 18 in the above-described manner to the sizing or stretch-reducing rolling line 22.

In this arrangement, practically the entire length of the tubular bloom 18 is protected against heat loss and scaling during rolling in the skew-rolling mill 22. The embodiment in FIG. 4 can act as an alternative to that of FIG. 3 if the friction in the longitudinal section 19*e* is sufficient to withdraw the bloom from the longitudinal section 19*d*, which can be achieved by appropriate dimensioning of the weights of the tubular bloom in the individual longitudinal sections 19*a* to 19*e*. In this case, the drive rolls 23 are not needed. The tubular bloom 18 is moved directly into the stretch-reducing rolling line 22 by the displacement of the longitudinal section 19*e*.

Figure 5:
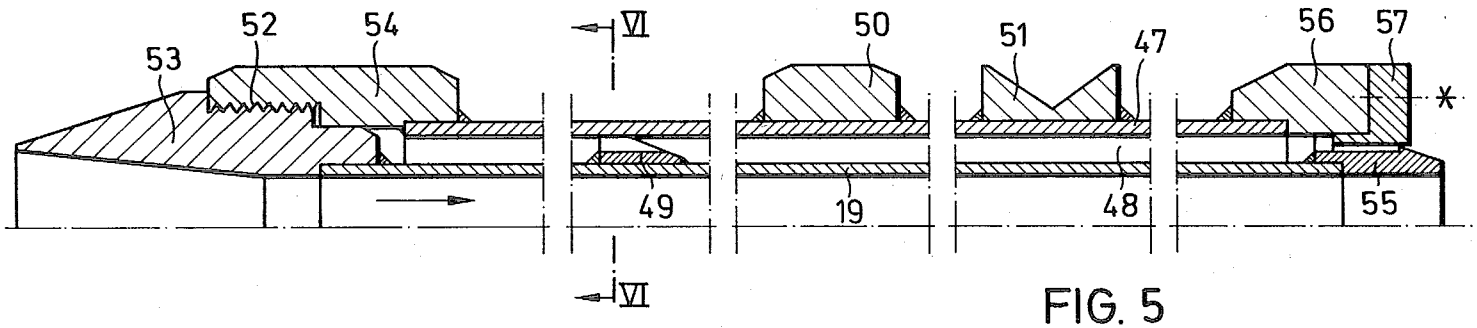
FIG. 5 is a longitudinal section through a guide tube.
Figure 6:
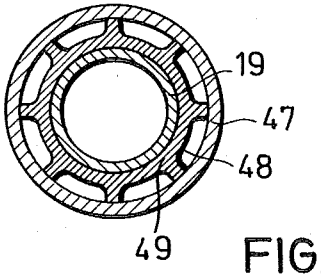
FIG. 6 is a section along the line VI—VI in FIG. 5.

In FIGS. 5 and 6, it can be seen that the guide tube 19 has a heating, insulating or cooling jacket 47. Between the internal surface and the external surface of the guide tube 19, there is an annulus 48 which is either flushed by a cooling or heating medium or filled with insulating material. The annulus is kept uniformly free by means of spacers 49, which are distributed along the length of the guide tube 19. These spacers 49 should, however, have as small a contact surface with the inner wall of the heating, insulating or cooling jacket 47 as possible, so that they transmit as little heat as possible, which is why the spacers 49 have a star-shaped cross-section, as can be seen, in particular, in FIG. 6. If possible, the spacers 49 should not be disposed in the region of the running faces 50 and 51 for the guide rolls 20 or 21 in order not to transmit any additional heat by way of the support faces to the guide rolls 20 and 21. At at least one end face (on the left in FIG. 5), the guide tube 19 is screwed to the heating, insulating or cooling jacket 47 by way of a thread 52 on welded-on end pieces 53 and 54. Two end pieces 55 and 56 are also provided on the other end section, but are not screwed together, in order to permit differences in thermal expansion. A safety piece 57, screwed onto the end piece 56, engages in a groove in the end piece 55 and thus prevents relative rotational movement between the guide tube 19 and the heating, insulating or cooling jacket 47, and hence an unscrewing of the thread 52.

Figure 7:
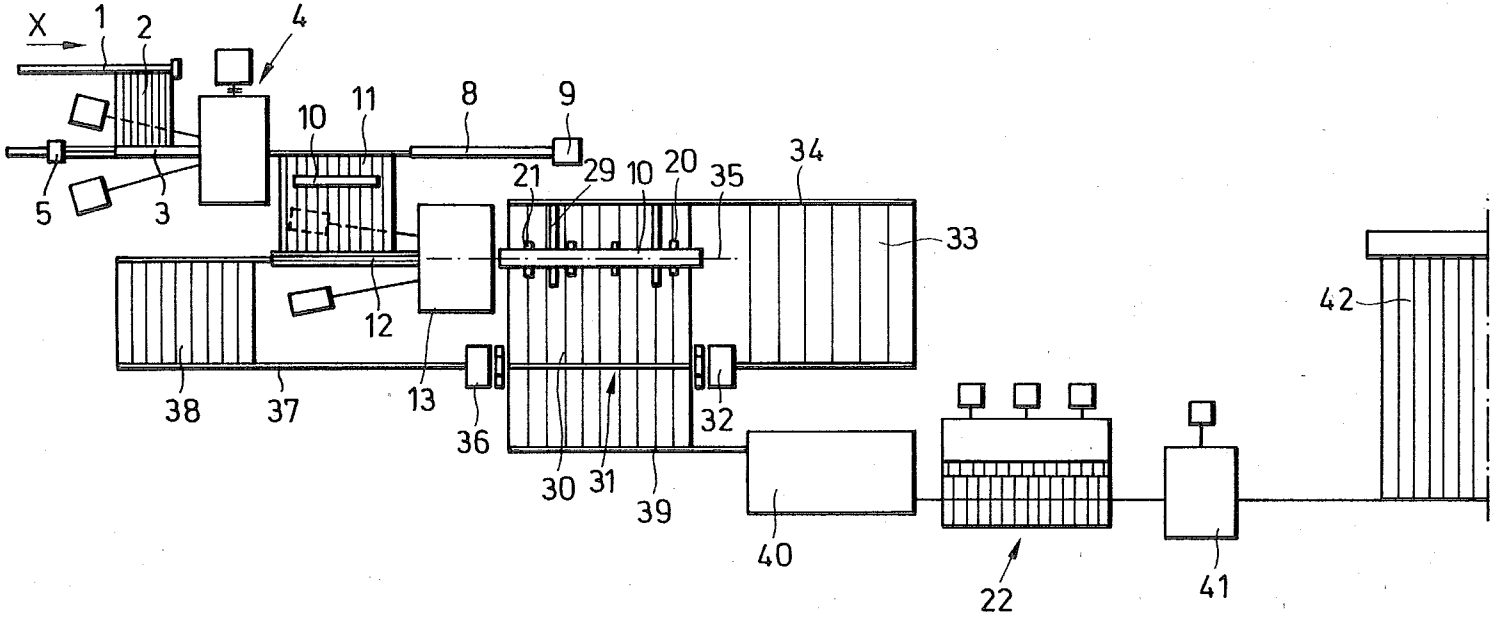
FIG. 7 is a plan view of a system having a skew-rolling mill according to the invention and a guide tube return arrangement at the delivery end.

In the embodiment as shown in FIG. 7, the feeding and delivery of the billets in the skew-rolling stand 4 functioning as a pierce-rolling stand is effected in the same way as in the embodiments according to FIGS. 1 and 2 up to the insertion channel 12 of the skew-rolling stand 13. Said stand has at the delivery end a guide tube 19 which is mounted in a similar way to that shown in FIG. 3, but without the lifting rolls 28 and their drive. If, following elongation, there is a tubular bloom 18 in the guide tube 19 and a mandrel rod 15 inside the tubular bloom 18, levers 29 can be used to lift the guide tube 19 off the guide rolls 20 and 21 so that the guide tube 19 containing the tubular bloom 18 containing the mandrel rod 15 passes by way of a transfer table 30 to a withdrawal station 31. The guide tube 19 is drawn off the tubular bloom 18 by means of a withdrawal device 32, from where the guide tube 19 can return to the region of the run-through axis 35 of the work material of the skew-rolling stand 13 by way of a storage and maintenance table 33 and a roller table 34. After the guide tube 19 has been drawn off, the mandrel rod is pulled out of the tubular bloom 18 by means of a second withdrawal device 36 and is passed by way of a roller table 37 to a storage and maintenance table 38 for the mandrel rods, from where the mandrel rod again passes, this time from the entry end, into the work material run-through axis 35 of the skew-rolling stand 13 and is then pushed into one of the following hollow billets. After the tubular bloom 18 has been freed from the guide tube 19 and the mandrel rod 15, it passes from the withdrawal station 31 by way of a roller table 39 into a re-heating furnace 40 and from there into the stretch-reducing rolling line 22, beyond which the parent tube produced therein is divided by a dividing device 41 and the tube sections are fed to a cooling bed 42.

I claim:

1. A skew-rolling stand for rolling hollow billets, in which the rolls of the stand are inclined relative to the run-through axis of the work material, and in which a work material guide divided into two or more individual longitudinal sections, and the longitudinal sections or least two of said longitudinal sections are individually rotatably driven, is provided at the delivery end of the stand and comprises a guide tube which coaxially encloses the run-through axis of the work material, and which is rotatable about its longitudinal center axis, is motor driven and is radially and axially guided externally and the mandrel is generally only on the entrance side of said rolls.

2. A skew-rolling stand as claimed in claim 1, in which the at least last guide tube is enclosed by a heating, insulating or cooling jacket.

3. A skew-rolling stand as claimed in claim 2, in which the guide tube is provided on the inside with an inert gas or a de-oxidizing lubricant.

4. A skew-rolling stand as claimed in claim 2, in which, in the case of guide tube of different internal diameters, the outer diameter of their heating, insulating or cooling jacket has the same dimension, at least in the region of its mounting.

5. A skew-rolling stand as claimed in claim 4, in which the guide tube is provided on the inside with an inert gas or a de-oxidizing lubricant.

6. A skew-rolling stand as claimed in claim 1, in which the guide tube is provided on the inside with an inert gas or a de-oxidizing lubricant.

7. A skew-rolling stand as claimed in claim 1, in which, in the region of at least one of the portions between the longitudinal sections, motor-driven driving rolls are provided which can be radially adjusted relative to the work material and drive said work material optionally in the axial direction.

8. A skew-rolling stand as claimed in claims 1, 2, 4, 6, 7, 3, or 5, in which the guide tube or a longitudinal section thereof can be displaced in the axial direction.

9. A skew-rolling stand as claimed in claims 1, 2, 4, 6, 3 or 5, in which the guide tube and the work material therein can be laterally ejected from the run-through axis of the work material and, after the work material has been removed axially, can be returned by way of a return arrangement to the region of the run-through axis of the work material.

10. A skew-rolling stand as claimed in claims 1, 2, 4, 6, 7, 3 or 5, in which the run-through axis of the work material and the guide tube form a straight line with the work material run-through axis of a reducing or sizing rolling line disposed directly downstream.

* * * * *